United States Patent [19]

Izzi, Sr.

[11] 4,423,526

[45] Jan. 3, 1984

[54] RESILIENT GASKET BETWEEN TOILET BOWL AND DRAINPIPE

[75] Inventor: Lewis B. Izzi, Sr., Shelby, N.C.

[73] Assignee: Plastic Oddities, Inc., Shelby, N.C.

[21] Appl. No.: 370,187

[22] Filed: Apr. 21, 1982

[51] Int. Cl.[3] ..... E03D 11/10; E03D 11/16; F16J 15/12

[52] U.S. Cl. ..... 4/252 R; 277/212 F; 277/207 A; 277/208

[58] Field of Search ..... 277/207 R, 207 A, 207 B, 277/208, 212 R, 212 C, 212 F, 212 FB, 12, 32, 166, 186; 4/252 R

[56] References Cited

U.S. PATENT DOCUMENTS

| | | | |
|---|---|---|---|
| 572,575 | 12/1896 | Scott | 4/252 R X |
| 696,183 | 3/1902 | McAuliffe | 277/212 F |
| 807,265 | 12/1905 | Gutelius | 277/212 F |
| 2,750,216 | 6/1956 | Thies | 4/252 R |
| 2,985,291 | 5/1961 | Schoepe et al. | 277/212 X |
| 3,012,252 | 12/1961 | Gaddy | 4/252 R |
| 3,199,879 | 8/1965 | Fleming | 277/212 F |
| 3,319,268 | 5/1967 | Blumenkranz | 4/252 R |
| 3,349,412 | 10/1967 | Schwartz et al. | 277/208 X |
| 4,207,630 | 6/1980 | Bressler | 4/252 R |

*Primary Examiner*—Robert S. Ward
*Attorney, Agent, or Firm*—Laurence R. Brown

[57] ABSTRACT

A toilet connection, coupling, gasket sealing device which is designed in one or more pieces to provide a combination of uses in completing the connection of a toilet outlet to the sewer drain pipe to prevent odors from escaping from the connection.

5 Claims, 4 Drawing Figures

RESILIENT GASKET BETWEEN TOILET BOWL AND DRAINPIPE

This invention relates generally to gaskets for sealing various plumbing connections and more specifically to a seal with a memory which does not use wax type gaskets.

As is well known, a flanged coupling of brass, cast iron, plastic, etc., is currently utilized for the connection of the toilet base to the drain line, and a wax type gasket is utilized to form the seal around the toilet flange, outlet and base. This is subject to various disadvantages among which are the fact that the seal is often lost in hot areas due to the melting of the wax.

Accordingly, the main object of the present invention is to provide an improved toilet gasket connnection which will obviate the foregoing and other disadvantageous features characterizing known structures.

An important object of the present invention is a toilet gasket which is molded, cast or otherwise formed in one piece from a flexible material which provides the drain connection and sealing to the toilet outlet without the use of wax or other type gaskets in addition to the coupling flange.

Another important object of the present invention is to provide a permanent sealing surface material with memory so that a toilet can be removed and replaced as required without needing additional sealing surface material as is required with wax type gaskets.

A further important object of the present invention is to provide a permanent sealing surface material which may be used with existing flanges of various materials or as the entire connector and/or sealing fitting that connects to the roughed in or existing sewage outlet pipe.

Other objects and advantages of the present invention will become apparent during the course of the following description.

In the drawings I have shown two embodiments of the invention. In these showings:

Figure 3:
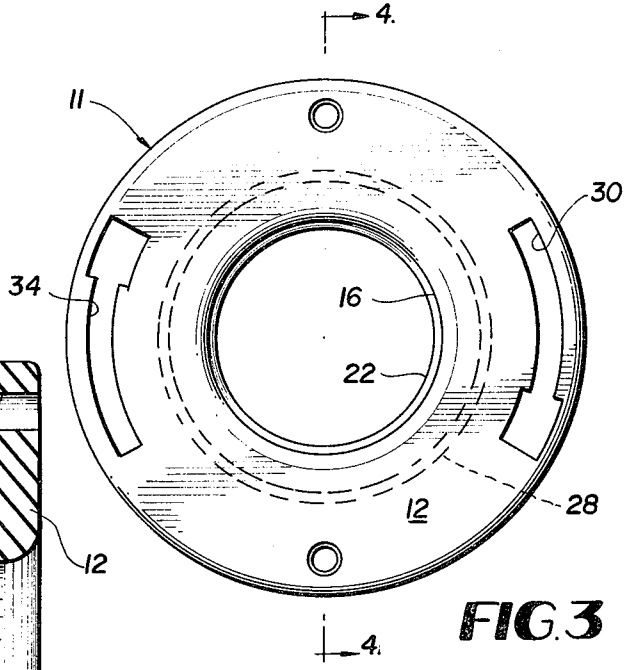
FIG 3 is a top plan view of the toilet gasket connection and sealer expanded into a gasket pipe connection in the flange outlet.

Referring to the drawings, numeral 10 designates the simplest form of the invention as a whole which comprises a flexible sealant material 12 with memory for use in existing or new installations with conventional flanges of plastic, brass cast iron, etc.

The connector 12 is of the same diameter as the base of the toilet and includes holes 14 for receiving bolts from the toilet flange. The connector is provided with a central outlet opening 16 to receive the toilet discharge from the toilet outlet horn (not shown) and its upper inner edge has a radius 18 to conform with the latter. The depending lower outer edge of the opening 16 is tapered for positive alignment and seal in the flange throat and drain pipe.

Thus, the connector 12 connects the toilet outlet to the sewer drain pipe and provides a positive gasket seal between outlet and pipe to prevent the escape of odors from around the connection. Further, the memory in the sealing surface material 12 allows the toilet to be removed and replaced as required with no additional materials required.

The coupling connection to a drain pipe may be connected as a rigid solvent weld or glue connection, or in a flexible connecton or "no-hub" connection to various materials such as plastic, cast iron, etc.

Figure 4:
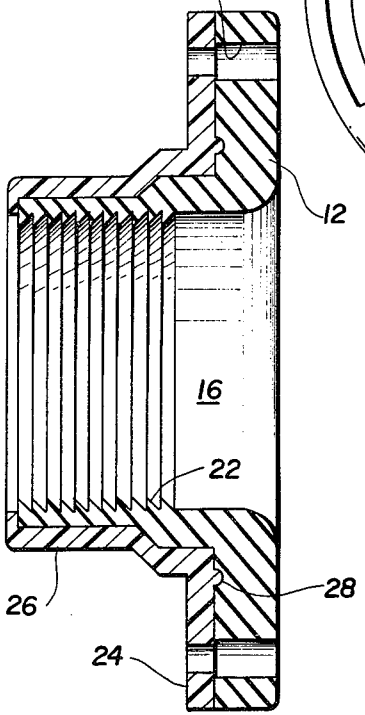
FIG. 4 is a central vertical sectional view thereof taken on the line 4—4 of FIG. 3.
Figure 1:
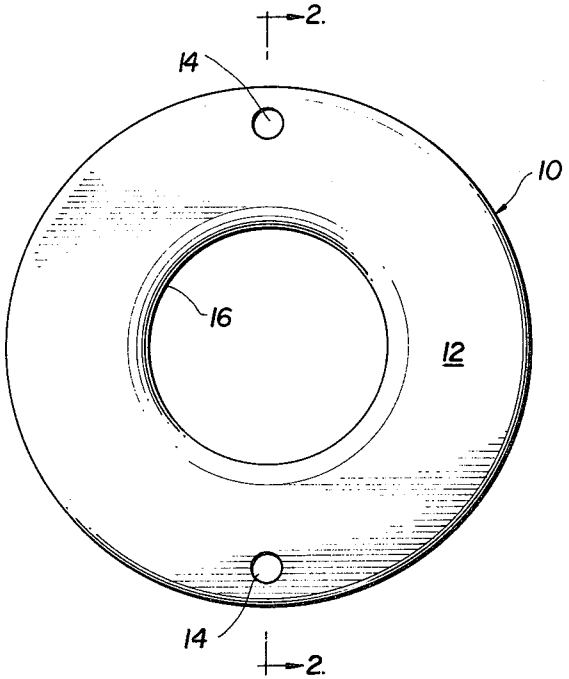
FIG. 1 is a top plan view of the toilet gasket connection and sealer.
Figure 2:
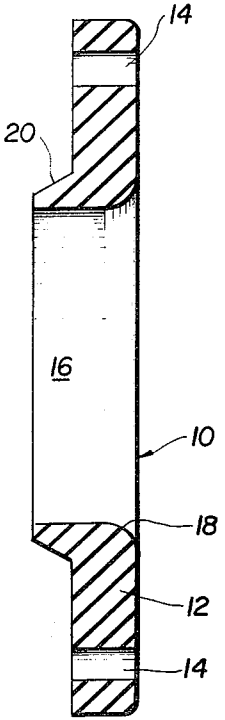
FIG. 2 is a central vertical sectional view thereof taken on the line 2—2 of FIG. 1.

As is shown in FIGS. 3 and 4, the toilet gasket connection and sealer is expanded from a flexible disc 10 to a gasket pipe connection 11 having threads 22 in the downwardly extended flange outlet 16.

The seal 12 and its outlet 16 are encased in a rigid flange 24 and connector shell 26 of either plastic, brass, cast iron, etc. for ease of installation and sealing to the toilet outlet and drain pipe. The rigid flange 24 of the shell 26 is provided with an upstanding gasket retainer ring 28 and conventional arcuate anchoring slots 30.

It will now be apparent that the combination of features described above offers advantages of time and labor cost savings from utilization of one component instead of two, flexibility of installation with a variety of materials, and savings of time and cost in future repairs.

It is to be understood that the forms of my invention herewith shown and described are to be taken as preferred examples of the same and that various changes in the shape, size and arrangement of parts may be resorted to without departure from the spirit of the invention or the scope of the subjoined claims.

What is claimed is:

1. A gasket sealing device for fitting inside a rigid generally cylindrical shell member for connecting a toilet bowl with an outlet horn to a drain pipe, said shell member having a circumferential flange surrounding a central opening connection to a drain pipe and with bolt holes through the flange for mounting the flange and drain pipe firmly to a floor and for supporting the toilet bowl on the flange, the sealing device for fitting concentrically between the toilet bowl and inner surface of the shell member for preventing the escape of odors from the seal between a toilet bowl mounted on the flange and the drain pipe, comprising in combination, a flexible disc of sealant material having a memory that causes it to attain its original shape after being flexed, said disc having a diameter great enough to substantially cover said flange with bolt holes on opposite sides of the disc in registration with bolt holes of the flange, said disc further having a central opening for extending inside the shell central opening and shaped for receiving thereinto the toilet bowl outlet horn in frictionally contacting sealing engagement to flexibly engage the toilet bowl horn and conform to its shape thereby to keep odors from escaping from the drain pipe through the sealing engagement, whereby the toilet bowl can be removed and replaced and thereby still attain a frictional leakproof seal even if not exactly replaced in the same position because of the sealant material memory without requiring replacement of the disc, and whereby the location of the disc may be retained in place and centered on the flange by means of the registered bolt holes.

2. The gasket sealing device defined in claim 1 wherein the disc has a depending rim surrounding the central opening directed away from the disc with its outer surface tapered for positive alignment in the flange.

3. The gasket sealing device defined in claim 1 wherein the disc has a depending rim surrounding the central opening directed away from the disc with an interior surface having thread-like grooves extending therefrom for sealing the disc to form a flexible friction connection to a drain pipe disposed into the central opening.

4. The gasket sealing device defined in claim 1 having thereon a concentric sealing gasket member profile for resiliently engaging and sealing a mating profile in the rigid shell member flange.

5. The gasket sealing device defined in claim 1 having said disc and said shell member with contiguous mating surfaces thereby forming substantially an integral unit.

* * * * *